US007918316B2

(12) United States Patent
Beier

(10) Patent No.: US 7,918,316 B2
(45) Date of Patent: Apr. 5, 2011

(54) SEPARATING DEVICE IN A MOTOR VEHICLE OIL CIRCUIT

(75) Inventor: Gerhard Beier, Penzberg (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 1083 days.

(21) Appl. No.: 10/975,358

(22) Filed: Oct. 29, 2004

(65) Prior Publication Data

US 2005/0103571 A1 May 19, 2005

Related U.S. Application Data

(63) Continuation of application No. PCT/EP03/03508, filed on Apr. 4, 2003.

(30) Foreign Application Priority Data

Apr. 30, 2002 (DE) ..... 102 19 279

(51) Int. Cl.
*F01M 11/08* (2006.01)

(52) U.S. Cl. ..... 184/6.23; 184/6.24

(58) Field of Classification Search ..... 184/6.23, 184/6.24, 6.21
See application file for complete search history.

(56) References Cited

U.S. PATENT DOCUMENTS

| | | | | | |
|---|---|---|---|---|---|
| 2,432,130 | A | * | 12/1947 | Serrell et. al. | 184/6.13 |
| 4,092,137 | A | * | 5/1978 | Howe et al. | 96/190 |
| 4,255,099 | A | * | 3/1981 | Komori | 418/97 |
| 4,714,139 | A | * | 12/1987 | Lorenz et al. | 184/6.11 |
| 4,872,890 | A | * | 10/1989 | Lamprecht et al. | 55/323 |
| 4,906,264 | A | * | 3/1990 | Szymaszek et al. | 55/324 |
| 4,913,695 | A | * | 4/1990 | Gantzer | 494/2 |
| 5,584,650 | A | * | 12/1996 | Redmond et al. | 415/55.5 |
| 5,676,717 | A | * | 10/1997 | Cope et al. | 55/321 |
| 6,530,367 | B2 | * | 3/2003 | Akiwa et al. | 123/572 |

FOREIGN PATENT DOCUMENTS

| | | | |
|---|---|---|---|
| DE | 693 488 | | 7/1940 |
| DE | 1 903 295 | | 1/1969 |
| DE | 2005 594 | | 2/1970 |
| DE | 2005594 | | 2/1970 |
| DE | 2 201 877 | | 1/1972 |
| DE | 7443014 | | 11/1976 |
| DE | 36 23 238 | A1 | 7/1986 |
| DE | 100 29 844 | A1 | 6/2000 |
| EP | 0 284 727 | A2 | 2/1988 |
| JP | 01233832 | | 4/1991 |
| JP | 03096610 | A * | 4/1991 |

OTHER PUBLICATIONS

International Search Report, Apr. 4, 2003.
International Search Report (English Translation).
European Search Report.

* cited by examiner

*Primary Examiner* — David M Fenstermacher
(74) *Attorney, Agent, or Firm* — Crowell & Moring LLP

(57) ABSTRACT

The invention relates to a cyclone separator integrated into the cover of an oil tank for separating an oil flow charged with gas into a flow which is low in air and into a flow which contains air.

5 Claims, 2 Drawing Sheets

Fig. 2a
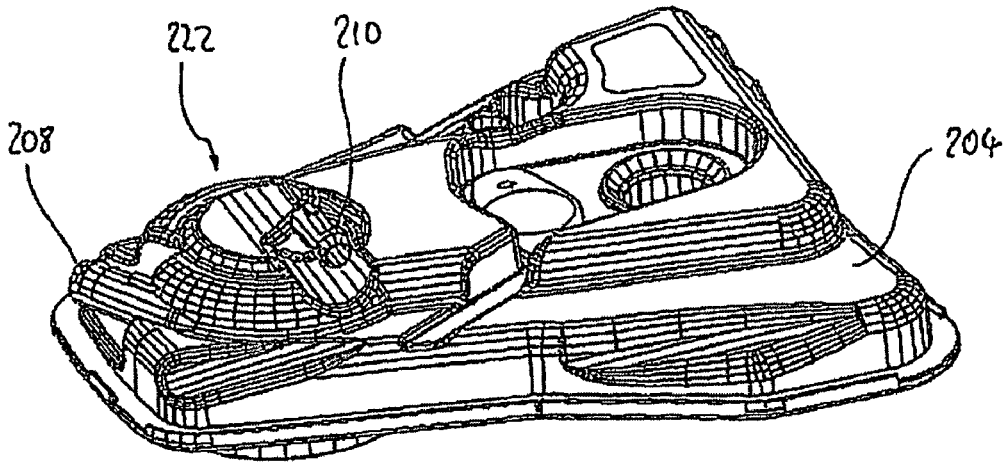
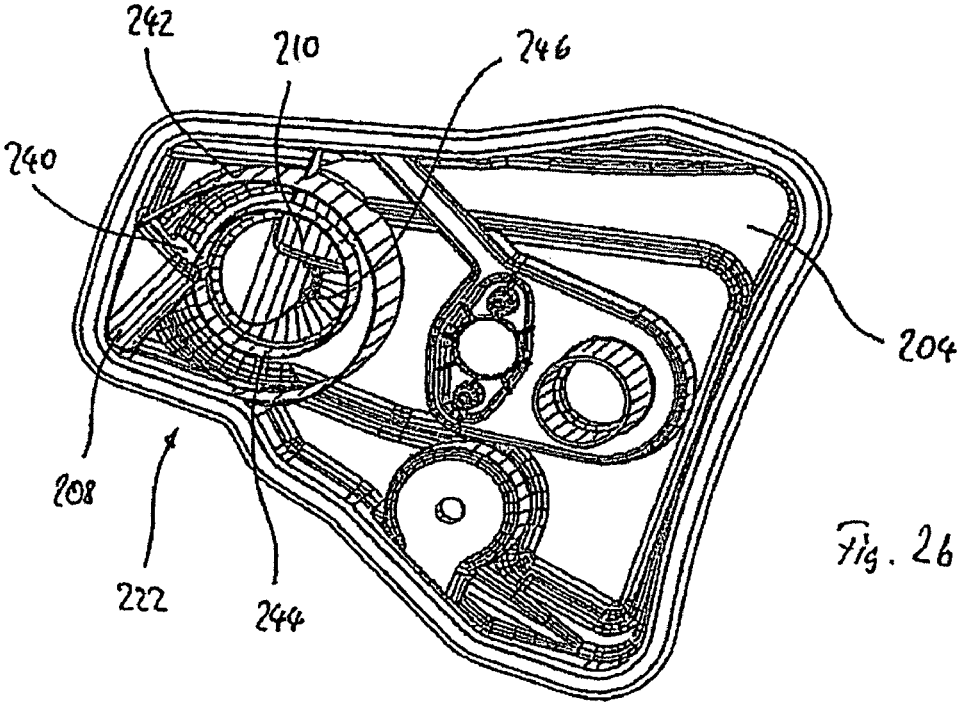
Fig. 2b

SEPARATING DEVICE IN A MOTOR VEHICLE OIL CIRCUIT

This application claims the priority of German application no. 102 19 279.0, filed Apr. 30, 2002 and PCT International Patent Application No. PCT/EP03/03508, filed Apr. 4, 2003, the disclosure of which is expressly incorporated by reference herein.

BACKGROUND AND SUMMARY OF THE INVENTION

The invention relates to a separating device in an oil circuit of a motor vehicle, comprising a pressure-generating oil pump and an oil tank, for separating an oil stream loaded with gas into one partial stream with little air and a partial stream containing air with a curved guide rib, by means of which an oil stream introduced tangentially on the inside of it is diverted/set in rotation.

Oil for cooling and/or as a lubricant is generally used in circulation in a circuit, especially in the motor vehicle area. In this process, starting from an oil reservoir/tank, oil is pumped by means of an oil pump through supply lines to the site of action and pumped back to the tank through return lines, whereby the pump(s) can be arranged either between the tank and the site of action and/or between the site of action and the tank. Since air is normally also present, in addition to the oil in the circuit, a loading of the liquid oil with gaseous air is unavoidable due to the (circulation) movement so the oil more or less foams.

Oil loaded with air is greatly restricted in its effects with respect to lubrication and/or heat transporting capability, resulting in the occurrence of increased wear and thus a reduced service life, e.g., of an internal combustion engine. For this reason, an attempt is made on one hand to prevent loading the oil with air by using an appropriate oil movement, in addition oils are used that have a low tendency to foam. On the other hand it is still necessary to again degasify foamy oil loaded with air.

In this context, various methods and devices have become known for providing oil that is free of air. DE 26 23 238 C2, for example, describes a device for providing lubricant oil that is essentially free of air, whereby a so-called cyclone separator is used as the central separating element. According to DE 36 23 238 C2 the oil loaded with air is introduced by way of an inlet opening into the cyclone separator, by the use of one part of the oil pressure energy a separation occurs into a partial air stream with little air that escapes at the bottom and peripherally and a partial stream containing air that escapes at the top and/or centrally.

These types of air separators are known in principle, but they form a separate component that takes up construction space and involves a certain amount of expense for manufacturing and installation.

In this context, reference is made to DE 1 903 295 A1 and DE 2 005 594 A1 that show arrangements according to the preamble of claim 1. In each case, the air separator is an independent, very complicated component designed with a number of individual elements and mounted on the inside of the oil tank with great effort.

As a result of DE 1 903 295 A1, connecting ribs for connecting the bell to the supply tank are also necessary, as is a separate passage of the return line through the wall of the supply tank. According to DE 2 005 594 A1, the bell of the separately-formed defoaming device is fastened, using a screw, in a complicated way on a removable cover of one wall of the supply tank and thus not integrated. In addition, a passage for the return line that is separate from the defoaming device is necessary.

Thus the object of the invention is to provide a separating device for separating air from oil in an oil circuit with low manufacturing effort, low cost and reduced construction space.

According to the invention, the object is achieved by a separating device which is an integral component of the oil tank.

According to a preferred embodiment of the invention, an oil tank comprises a reservoir and a cover formed as an upper shell, and for formation of the separating device the cover itself is designed appropriately. The cover of the separating device is effectively manufactured of a plastic here, like polyamide.

It is especially advantageous if the oil stream introduced is shaped so that it is flat, by means of an appropriately designed intake device, so that it acts on a broad area of the guide rib.

It has proven to be very effective if the partial stream with little air is carried away downward and/or peripherally and the partial stream carrying air is carried away toward the top and/or centrally, in this process a dome that is open toward the bottom and extends into the tank radially on the inside, concentrically to a guide rib, is provided for return of the partial stream containing air. This dome makes possible for the carrying away to take place in a low-rotation space with little air movement.

Because of the very compact construction of the separating device, it is especially suitable for use in connection with an oil tank, especially in a motorcycle.

Other objects, advantages and novel features of the present invention will become apparent from the following detailed description of the invention when considered in conjunction with the accompanying drawings.

BRIEF DESCRIPTION OF THE DRAWINGS

FIG. 2*a* shows an upper shell of the oil tank shown in FIG. 1, comprising a separating device in top view and FIG. 2*b* shows an upper shell of the oil tank shown in FIG. 1, comprising a separating device viewed from below.

DETAILED DESCRIPTION OF THE DRAWINGS

Figure 1:
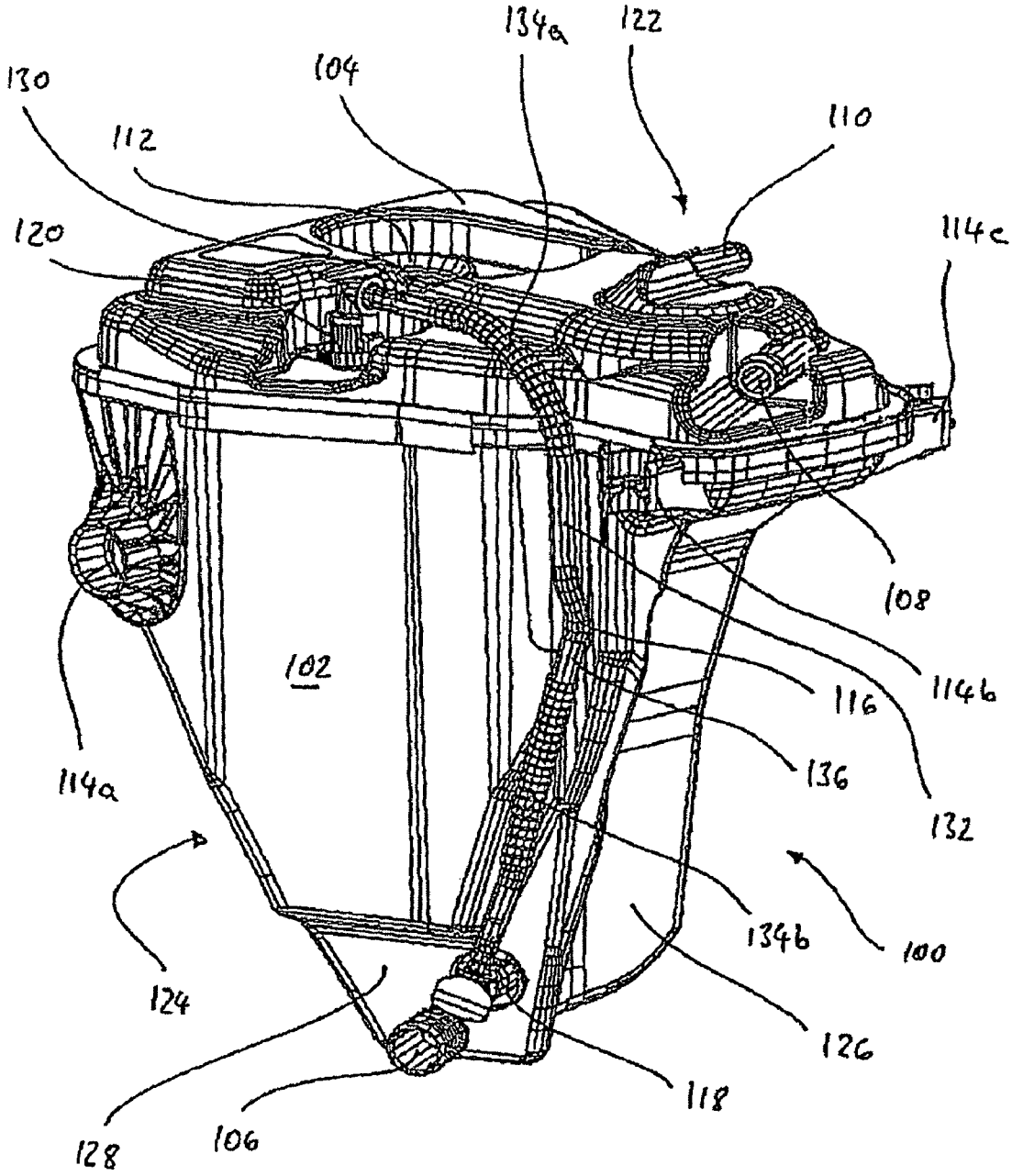
FIG. 1 shows an oil tank comprising a separating device in accordance with an embodiment of the present invention.

FIG. 1 shows a multi-part oil tank 100 consisting of a reservoir 102 and a cover 104, the oil tank serves as a reservoir for dry sump lubrication, especially for motorcycles to provide oil volume. In the present case, both reservoir 102 and cover 104 of the oil tank 100 shown consist of injection-molded, glass fiber reinforced polyamide (PA), tank parts 102, 104 are connected to each other so that they are sealed against oil. The reinforcement ribs necessary to reinforce the design are arranged on the inside so that the outer tank surface is designed embossed with radii between 250 and 500 mm, the main edges are rounded with radii of approx. 8 mm. In the present case, the oil tank 100 comprises an oil volume of about 3.25 l, plus 1 l, according to 25-30% air volume for use in a motorcycle.

In the lower area of the reservoir 102, an oil drain 106 is provided, through which during operation, oil is pumped to the site of action, e.g., for lubrication and/or cooling of an internal combustion engine by means of an oil pump arranged in the oil circuit between oil drain 106 and an oil supply line 108 provided in the cover 104. Also in the oil circuit, e.g., upstream of the oil supply 108, an oil cooler—not shown—is provided. Not least due to the supply pump that is not shown in more detail here, a loading of the oil with air occurs and therefore a separating device 122 for degasifying the foaming oil is provided in the area of the oil supply 108; the gases separated are carried away through an air escape pipe 110. An oil filler opening 112 is also integrated in the cover 104.

Two openings 120 in the upper and 118 in the lower area of the oil tank are connected to each other by means of a hose 116, so that the hose 116 forms a vessel that communicates with the tank volume. In the embodiment shown, the hose 116 consists of sections 134*a*, 134*b* of an oil-resistant composite elastomer hose and of a transparent PTFE tube 136, in the area of which the hose 116 is held with a clamp 132 or clipped onto tank 100. In the area of the transparent tube 136, there are markings to identify the minimum and maximum oil levels, the markings are either on tube 136 itself—whereby the danger exists of an incorrect reading due to imprecise installation of the hose 116—or on the tank. This makes possible an especially convenient inspection of the oil level without the use of a dip stick or the like. In the area of the upper opening 120, the hose 116 has a quick-connect for connecting to the cover 104, the hose can thus be loosened at its upper end and serves as a drain hose. In this context it is effective to provide the lower opening 118 at a very low point, preferably at the lowest point, of the oil tank 100. The use of the drain hose makes possible an especially service-friendly, simple and clean emptying of oil tank 100 into an oil collecting container without any danger of oil spills.

To fasten the oil tank 100 to a motorcycle not shown here in more detail, mounting points 114*a*, 114*b*, 114*c* are provided, whereby the oil tank 100 shown in this case is mounted on the vehicle in such a way that the back side 124 points toward the back wheel and the side 126 points toward the front. Side 128 is visible on the side of the motorcycle, which makes it possible to advantageously check the oil level and to empty the oil as described.

An upper shell 204 of an oil tank comprising a separating device 222 is shown in top view in FIG. 2*a*, a bottom view is shown in FIG. 2*b*. The separating device 222 for separating gases from the air-loaded oil is integrated in the cover 204 of the oil tank, in that an appropriate design of the cover 204 is produced during manufacturing in the injection-molding process. To introduce the oil loaded with gas, an oil inlet pipe 208 is provided which is designed as a flat nozzle in the inlet area 240, so that the oil stream introduced is fanned out, causing improved release of the air bubbles contained. Because of its fanning, the fanned-out oil stream is guided over almost its entire width tangentially onto a guide rib 242, which is curved inward, following the oil stream. In this way the oil stream is diverted and centrifugal forces occur that cause a separation of the air from the oil, with the air being carried away through an air escape pipe 210. Radially inside the guide rib 242, by means of a ring-shaped rib 244, a dome 246 is provided in order to form a space with little air movement, from which the separated air is carried away upward/centrally without notable eddy currents. The oil that is now free of air is directed upward/peripherally and is available for further use in the oil circuit.

The oil tank 100 according to the invention is also characterized by an especially low weight, the optimized separation of air from the oil circuit contributes to a considerable reduction in wear in the internal combustion engine.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Separating device in an oil circuit of a motor vehicle comprising a pressure-generating oil pump and an oil tank, wherein the separating device is an integral component of the oil tank, and comprises a curved guide rib, said rib being open to the oil tank along its length and arranged to separate an oil stream loaded with gas introduced tangentially on the curved rib into one partial stream with little air and one partial stream containing air, further wherein the oil tank comprises a reservoir and a cover formed as an upper shell, the separating device is molded as an integral part of the cover from a plastic material, and an axial width of said rib from the cover toward the reservoir does not extend below an upper end of transparent portion of an externally-viewable oil level indicator.

2. Separating device according to claim 1, wherein the plastic material is polyamide.

3. Separating device according to claim 1, wherein an inlet device is arranged to impart a flat shape to the oil stream.

4. Separating device according to claim 3, wherein the device is arranged such that the partial stream with little air is carried away peripherally at the bottom of the separating device and the partial stream containing air is carried away at the top of the separating device.

5. Separating device according to claim 4, wherein the partial stream containing air is returned by way of a dome formed by a ring-shaped rib that is located on the inside radially, concentric to the guide rib.

* * * * *